US011359442B2

(12) United States Patent
Edwards

(10) Patent No.: US 11,359,442 B2
(45) Date of Patent: Jun. 14, 2022

(54) TUBULAR FOR DOWNHOLE USE, A DOWNHOLE TUBULAR SYSTEM AND METHOD OF FORMING A FLUID PASSAGEWAY AT A TUBULAR FOR DOWNHOLE USE

(71) Applicant: Jason Edwards, Tulsa, OK (US)

(72) Inventor: Jason Edwards, Tulsa, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 55 days.

(21) Appl. No.: 16/893,801

(22) Filed: Jun. 5, 2020

(65) Prior Publication Data

US 2021/0381324 A1 Dec. 9, 2021

(51) Int. Cl.
*E21B 17/18* (2006.01)
*E21B 23/02* (2006.01)

(52) U.S. Cl.
CPC ..... *E21B 17/18* (2013.01); *E21B 23/02* (2013.01)

(58) Field of Classification Search
CPC ..... E21B 17/18; E21B 17/203; E21B 21/12; E21B 23/02; E21B 33/0355; E21B 33/0387; E21B 34/10
See application file for complete search history.

(56) References Cited

U.S. PATENT DOCUMENTS

| | | | | |
|---|---|---|---|---|
| 4,598,773 | A * | 7/1986 | Pringle | E21B 34/10 166/373 |
| 4,791,991 | A * | 12/1988 | Morris | E21B 34/10 166/319 |
| 5,862,864 | A * | 1/1999 | Whiteford | E21B 34/101 166/321 |
| 6,260,850 | B1 * | 7/2001 | Beall | E21B 17/025 166/242.3 |
| 6,523,614 | B2 | 2/2003 | Dennistoun et al. | |
| 7,409,996 | B2 | 8/2008 | Myerley et al. | |
| 7,775,269 | B2 | 8/2010 | Dennistoun et al. | |
| 2005/0230122 | A1 * | 10/2005 | Cho | E21B 23/04 166/381 |
| 2015/0144360 | A1 * | 5/2015 | Shearer | E21B 21/12 166/386 |
| 2018/0274299 | A1 * | 9/2018 | Strange | E21B 7/067 |

* cited by examiner

*Primary Examiner* — David Carroll
(74) *Attorney, Agent, or Firm* — Cantor Colburn LLP

(57) ABSTRACT

A tubular for downhole use including a wall defining an inner bore; a fluidic passageway formed within the wall that is fluidically isolated from the inner bore; a portion of the wall being located between the inner bore and the fluid passageway and configured to maintain fluidic isolation between the inner bore and the fluid passageway until an opening is formed through the portion.

6 Claims, 1 Drawing Sheet

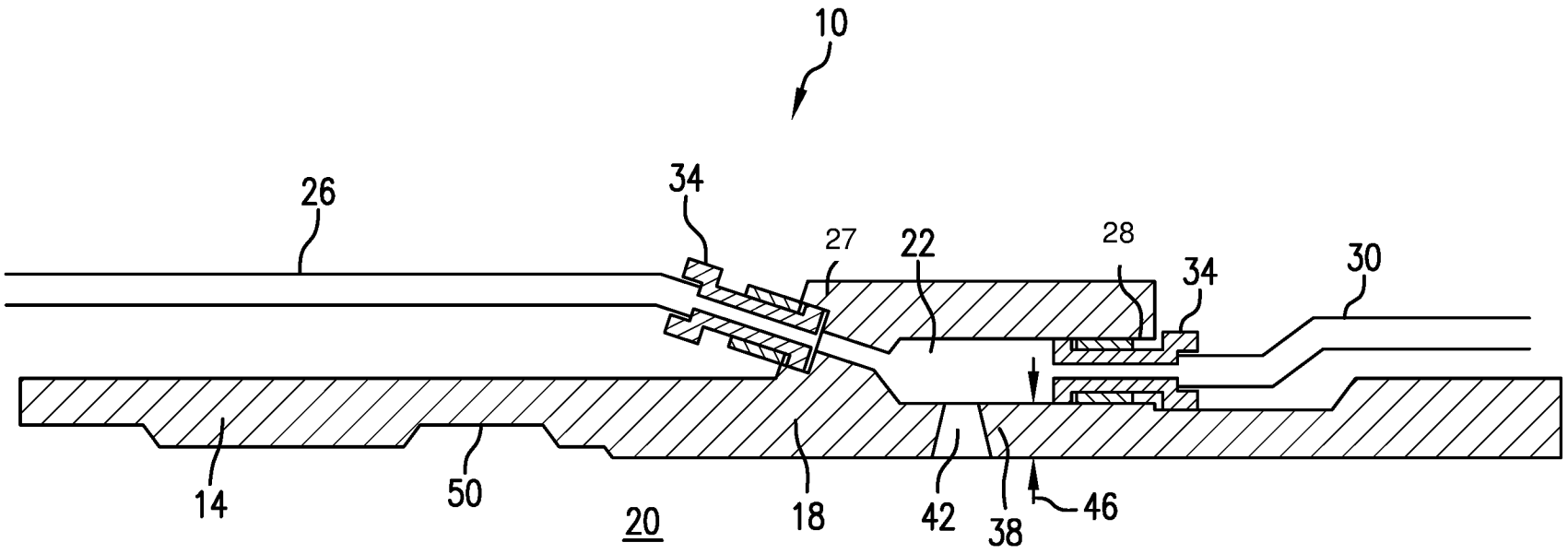
10
34
27
22
28
34
30
26
18
42
38
46
20
50
14

TUBULAR FOR DOWNHOLE USE, A DOWNHOLE TUBULAR SYSTEM AND METHOD OF FORMING A FLUID PASSAGEWAY AT A TUBULAR FOR DOWNHOLE USE

BACKGROUND

In the resource recovery industry nipples are often employed to allow tools run downhole to connect to. Some nipples are tubulars that employ seals that create fluidic separation between an inner bore and a control line positioned radially outward of the nipple. While such nipples serve the purpose for which they were designed, the industry is always open to new configurations of such devices.

SUMMARY

Disclosed in an embodiment is a tubular for downhole use including a wall defining an inner bore; a fluidic passageway formed within the wall that is fluidically isolated from the inner bore; a portion of the wall being located between the inner bore and the fluid passageway and configured to maintain fluidic isolation between the inner bore and the fluid passageway until an opening is formed through the portion.

Disclosed in an embodiment is a downhole tubular system including a wall defining an inner bore, a fluidic passageway formed within the wall that is fluidically isolated from the inner bore, a portion of the wall being located between the inner bore and the fluid passageway and configured to maintain fluidic isolation between the inner bore and the fluid passageway until an opening is formed through the portion; a first line fluidically connected to the wall at the fluid passageway; and a second line fluidically connected to the wall at the fluid passageway.

Disclosed in an embodiment is a method of forming a fluid passageway at a tubular for downhole use including providing a tubular having a wall defining an inner bore; providing a fluidic passageway within the wall that is fluidically isolated from the inner bore; providing a portion of the wall located between the inner bore and the fluid passageway configured to maintain fluidic isolation between the inner bore and the fluid passageway until an opening is formed through the portion.

BRIEF DESCRIPTION OF THE DRAWINGS

The following descriptions should not be considered limiting in any way. With reference to the accompanying drawings, like elements are numbered alike:

The FIGURE depicts a cross-sectional view of a tubular system disclosed herein.

DETAILED DESCRIPTION

A detailed description of one or more embodiments of the disclosed apparatus and method are presented herein by way of exemplification and not limitation with reference to the FIGURES.

Hydraulic control lines are often employed downhole to allow control of subsurface safety valves, and other tools, via changes in hydraulic pressure that is provided from surface through the control lines. it may be desirable to maintain fluidic separation between an inner bore of the tubular and a control line permanently or just until such time that fluidic communication is desired. One example when such separation would be desired is when a pressure needed to open a safety valve is less than pressure within the tubular, i.e. the inner bore. In such a case, were fluidic communication between the inner bore and the control line to be established then the valve could be stuck open, thereby preventing operation via pressure changes in the control line. While some tubulars are designed to maintain this fluidic separation, their construction might rely upon seals between tubulars that can fail over time due to deterioration from exposure to caustic fluids or mechanical loading, for example. Embodiments disclosed herein avoid the foregoing failure modes.

Referring to the FIGURE, a downhole tubular system disclosed herein is illustrated and identified with reference character 10. The system 10 includes a tubular 14 with a wall 18 defining an inner bore 20 that may serve as a flow bore of a drill string. The wall 18 also includes a fluid passageway 22 that is fluidically isolated from the inner bore 20. The wall 18 is configured to have a first line 26 fluidically connected to one axial end 27, such as an up-hole end, of the fluid passageway 22 and a second line 30 fluidically connected to another axial end 28, such as a downhole end, of the fluid passageway 22. The lines 26, 30 and the passageway 2 may serve as a control line for wellbore operations. In addition to the lines 26, 30, the system 10 may also include a jam nut 34 for sealingly attaching either or both lines 26, 30 to the wall 18 at the fluid passageway 22.

A portion 38 of the wall 18 is located between the inner bore 20 and the fluid passageway 22 and is configured to maintain fluidic isolation between the inner bore 20 and the fluid passageway 22 if and until fluidic communication therebetween is desired. The portion 38 is configured to have an opening 42 formed therethrough to establish fluidic communication between the inner bore 20 and the fluid passageway 22. A thickness 46 of the portion 38 may be selected to facilitate formation of the opening 42.

The wall 38 may include features 50, such as locking profiles and perimetrical recesses for example, along the inner bore 20 that help to axially locate and rotationally orient an opening tool (not shown) run downhole through the inner bore 20 configured to create the opening 42 in the portion 38.

Set forth below are some embodiments of the foregoing disclosure:

Embodiment 1: A tubular for downhole use including a wall defining an inner bore; a fluidic passageway formed within the wall that is fluidically isolated from the inner bore; a portion of the wall being located between the inner bore and the fluid passageway and configured to maintain fluidic isolation between the inner bore and the fluid passageway until an opening is formed through the portion.

Embodiment 2: The tubular of any prior embodiment, wherein the inner bore of the tubular serves as a flow bore of a drill string.

Embodiment 3: The tubular of any prior embodiment, wherein wall includes at least one feature along the inner bore to axially locate and/or rotationally orient an opening tool relative to the portion.

Embodiment 4: A downhole tubular system including a wall defining an inner bore, a fluidic passageway formed within the wall that is fluidically isolated from the inner bore, a portion of the wall being located between the inner bore and the fluid passageway and configured to maintain fluidic isolation between the inner bore and the fluid passageway until an opening is formed through the portion; a first line fluidically connected to the wall at the fluid passageway; and a second line fluidically connected to the wall at the fluid passageway.

Embodiment 5: The downhole tubular system of any prior embodiment, wherein the first line is positioned on one axial end of the fluid passageway and the second line is positioned on another axial end of the fluid passageway.

Embodiment 6: The downhole tubular system of any prior embodiment, wherein the first line is positioned on an up-hole end of the fluid passageway and the second line is positioned on a downhole end of the fluid passageway.

Embodiment 7: The downhole tubular system of any prior embodiment, wherein the lines and the fluid passageway serve as a control line.

Embodiment 8: The downhole tubular system of any prior embodiment, further comprising a jam nut for sealingly attaching at least one of the first line and the second line to the wall at the fluid passageway.

Embodiment 9: A method of forming a fluid passageway at a tubular for downhole use including providing a tubular having a wall defining an inner bore; providing a fluidic passageway within the wall that is fluidically isolated from the inner bore; providing a portion of the wall located between the inner bore and the fluid passageway configured to maintain fluidic isolation between the inner bore and the fluid passageway until an opening is formed through the portion.

Embodiment 10: The method of any prior embodiment, further comprising providing at least one jam nut for attaching a line to the wall at at least one end of the passageway.

Embodiment 11: The method of any prior embodiment, further comprising providing features on the inner bore configured to axially locate and/or rotationally orient an opening tool run relative to the portion of the wall.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubular for downhole use comprising:

a wall defining an inner bore;

a fluidic passageway formed within the wall that is fluidically isolated from the inner bore;

a portion of the wall being located between the inner bore and the fluid passageway and configured to maintain fluidic isolation between the inner bore and the fluid passageway until an opening is formed through the portion, the wall including at least one feature along the inner bore to axially locate and/or rotationally orient an opening tool relative to the portion;

a first line fluidically connected to the wall at the fluid passageway; and a second line fluidically connected to the wall at the fluid passageway.

2. The tubular of claim 1, wherein the inner bore of the tubular serves as a flow bore of a drill string.

3. The downhole tubular system of claim 1, wherein the first line is positioned on one axial end of the fluid passageway and the second line is positioned on another axial end of the fluid passageway.

4. The downhole tubular system of claim 1, wherein the first line is positioned on an up-hole end of the fluid passageway and the second line is positioned on a downhole end of the fluid passageway.

5. The downhole tubular system of claim 1, wherein the lines and the fluid passageway serve as a control line.

6. The downhole tubular system of claim 1, further comprising a jam nut for sealingly attaching at least one of the first line and the second line to the wall at the fluid passageway.

* * * * *